US006712677B2

(12) United States Patent
Williams et al.

(10) Patent No.: US 6,712,677 B2
(45) Date of Patent: Mar. 30, 2004

(54) PORTABLE SAND BLASTING CABINET AND ACCESSORY END CAPS

(76) Inventors: William A. Williams, 82 Constance Way West, Rochester, NY (US) 14612; Thomas H. Church, Jr., 9165 Footemill Rd., Erie, PA (US) 16509

( * ) Notice: Subject to any disclaimer, the term of this patent is extended or adjusted under 35 U.S.C. 154(b) by 458 days.

(21) Appl. No.: 09/871,937

(22) Filed: Jun. 4, 2001

(65) Prior Publication Data

US 2002/0182988 A1 Dec. 5, 2002

(51) Int. Cl.[7] ..... B24C 9/00
(52) U.S. Cl. ..... 451/89; 451/90; 451/451
(58) Field of Search ..... 451/87, 88, 89, 451/90, 75, 38, 451

(56) References Cited

U.S. PATENT DOCUMENTS

| | | | | |
|---|---|---|---|---|
| 1,773,374 A | | 8/1930 | Ruemelin | |
| 3,599,375 A | | 8/1971 | Nunemaker | |
| 4,098,033 A | * | 7/1978 | Mann | 451/89 |
| 4,300,318 A | * | 11/1981 | Brown | 451/88 |
| 4,993,199 A | | 2/1991 | Hughes | |
| 5,038,527 A | | 8/1991 | Fastje | |
| D323,661 S | | 2/1992 | Zwicker | |
| 5,775,979 A | | 7/1998 | Coke et al. | |
| 6,099,395 A | * | 8/2000 | Guseman | 451/75 |

FOREIGN PATENT DOCUMENTS

| | | |
|---|---|---|
| JP | 52034496 | 3/1977 |
| JP | 58077452 | 5/1983 |
| JP | 63196379 | 8/1988 |

* cited by examiner

*Primary Examiner*—Joseph J. Hail, III
*Assistant Examiner*—David B. Thomas
(74) *Attorney, Agent, or Firm*—Richard C. Litman

(57) ABSTRACT

A portable, self-contained sand blaster including a cabinet and accessory end caps. The caps include a solid end wall, an extension box for treating larger parts in the cabinet, a softboot with drawstring closure affixed about parts to be treated, and a softboot with a magnetic opening for attachment to rusted, relatively flat surfaces. The base is wheeled and has controls, a vacuum for dust, a sand supply, and a blast cabinet on top; the base includes connectors for hookup to electric power and a source of compressed air. A media filter screens out rust particles form the media.

13 Claims, 9 Drawing Sheets

PORTABLE SAND BLASTING CABINET AND ACCESSORY END CAPS

BACKGROUND OF THE INVENTION

1. Field of the Invention

The present invention relates to sand blasting cleaning devices, and more particularly to a portable, self-contained sand blasting cabinet with accessory end caps providing a wide range of cleaning operations, both inside the cabinet, inside an extended cabinet, and inside extensible shields which may be closed about a work area.

2. Description of the Related Art

There is a need in the art for a portable, self-contained sand blaster with an interchangeable end wall structure to accommodate an extended box to effectively lengthen the sand blaster cabinet, or a flexible, soft boot end cap with a drawstring end, or a magnetic end, to seal about a work object, all as provided by the instant invention but not taught or seen in the related art.

An anecdotal summary follows, indicating just one area where the instant invention solves an as yet unsolved major problem.

Vehicle repair in northern climates (upstate New York, for example) often involves dealing with rust and corrosion, caused by constant exposure to snow, salt and ice from fall to spring. In just dealing with brake systems alone, often rust and/or corrosion will impact the fit of a disc brake rotor to its hub, the fit of brake pads in their mounting brackets, and caliper movement on its mounts. The present art methodology in dealing with the problem is to grind off the rust by a labor intensive operation, usually involving an angle grinder and a wide variety of abrasive discs for each job. Not only is the process unduly long and tiresome, often hard-to-reach areas are missed and 10 to 20 discs may be used (these cost 60 to 80 cents each). Obviously, the process is costly. It is also environmentally unfriendly, as the discs create an airborne cloud of rust dust in the shop. The process can be dangerous to technicians' eyes as well as lungs.

Now, some establishments simply absorb the extra cost, while other pass it on to their customers. Because of the costs involved, some simply do little or no cleaning of the parts, often resulting in an unsatisfactory brake job.

One answer is, of course, the use of a conventional, hand-held siphon feed sand blaster. Sandblasters do a fine and complete job of cleaning, even in hard to reach areas, and do not damage the underlying structure. This works just fine on any removable part, but is excessively messy and must be done outdoors, and presents obvious safety and environmental risks. Another answer is the use of a conventional sandblasting cabinet, again for the removable parts. However, these solutions do nothing for the parts that cannot be readily removed from the vehicle, namely (for example) the brake hub, calipers, and in some instances, the knuckle. Additionally, vehicle bodies are subjected to rust and corrosion. In the body shop environment, sandblasting would be a solution, but the job is messy and difficult to do on parts not readily removable from the vehicle.

The flexibility provided by the present invention, which allows sandblasting within a cabinet or on vehicle parts on the vehicle, by use of a novel, flexible boot attached to the sandblasting cabinet and sealable about the part to be treated, solves the problems set forth above. Additionally, the present invention provides an extension to the cabinet for handling and cleaning removable, extended length parts.

The related art discussed below fairly reflects the present state of the art.

A portable sandblasting device including a wheeled cabinet, a sandblasting gun and a vacuum to remove airborne dust particles from the operation is taught in U.S. Pat. No. 3,599,375 issued Aug. 17, 1971, to Frank D. Nunemaker. A sandblasting cabinet with a pair of glove ports is disclosed in U.S. Pat. No. Des. 323,661 issued Feb. 4, 1992, to Fred Zwicker.

U.S. Pat. No. 1,773,374 issued Aug. 19, 1930, to Richard Ruemelin shows a sandblasting hood movable up to the face of a stationary graveyard monument and generally sealed about the area to be sandblasted. A sand collection pail catches spent sand at a bottom of the hood.

A portable booth with glove ports and an internal system to prevent escape of cleaning fluids is seen in U.S. Pat. No. 4,993,199 issued Feb. 19, 1991, to Joel J. Hughes.

The remaining five patent documents to be discussed generally disclose abrasive blasting devices for large buildings or ships, and including a hood or shroud sealed up against a portion of the work surface to limit the escape of blast particles and collect the spent particles. These teachings include: U.S. Pat. No. 5,775,979 issued Jul. 7, 1998, to Dan A. Coke et al.; U.S. Pat. No. 5,038,527 issued Aug. 13, 1991, to Helmut Fasje; Japan Patent Document No. 52034496 published Mar. 16, 1977; Japan Patent Document No. 58077452 published May 10, 1983; and Japan Patent Document No. 63196379 published Aug. 15, 1988.

None of the above inventions and patents, taken either singularly or in combination, is seen to describe the instant invention as claimed. Thus a portable sand blasting cabinet and accessory end caps solving the aforementioned problems is desired.

SUMMARY OF THE INVENTION

The invention is a portable, self-contained sand blaster including a cabinet and accessory end caps. Parts to be treated by a sandblasting operation may be cleaned inside the cabinet, or inside extensions provided by the accessory end caps. The caps include a solid end wall, an extension box for treating larger parts in the cabinet, a softboot with drawstring closure affixed about parts to be treated and which cannot be conveniently removed and placed entirely within the cabinet, and a softboot with a magnetic opening for attachment to rather large, rusted or corroded (e.g., vehicle door panels), relatively flat surfaces.

The base is wheeled and has controls, a vacuum for safe evacuation of airborne dust particles, a bin or angled tube for the sand supply, and a blast cabinet on top. Conveniently, the base has a retractable electric cord with a male plug for hookup to a source of electricity. A source of compressed air is connected via a suitable connector to an air dryer and a compressed air line which leads to the sandblasting gun.

A media filter is located in a pullout tray at the base of the sandblasting cabinet. The filter has a mesh size sufficient to entrap large rust particles or parts that otherwise would reenter the sand stream and likely block the sandblasting gun during its use. If desired, a blow gun can be provided for cleaning dust off treated parts.

Accordingly, it is a principal object of the invention to provide a portable, self-contained sand blasting cabinet with accessory end caps, so that portable and fixed workpieces may be sandblasted within the cabinet or an end cap.

It is another object of the invention to provide a kit of end caps for a sandblasting cabinet, including a fixed wall, an extended length box for long workpieces, and a softboot end cap with a drawstring closure or magnets, for sealing an open end of the cap about a stationary work surface.

It is a further object of the invention to provide a portable sandblasting cabinet with an interior media filter above the sand supply which has a mesh size sufficient to block and entrap large particles from the sand supply, and thus prevent the sandblasting gun from becoming clogged by such debris and thus inoperable.

Still another object of the invention is to provide a portable sandblasting cabinet with a shop vacuum for dust, and operated by a knee-operable switch so that the sandblaster may be turned on and off by an operator without having to remove the hands from the gloves ports of the device.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
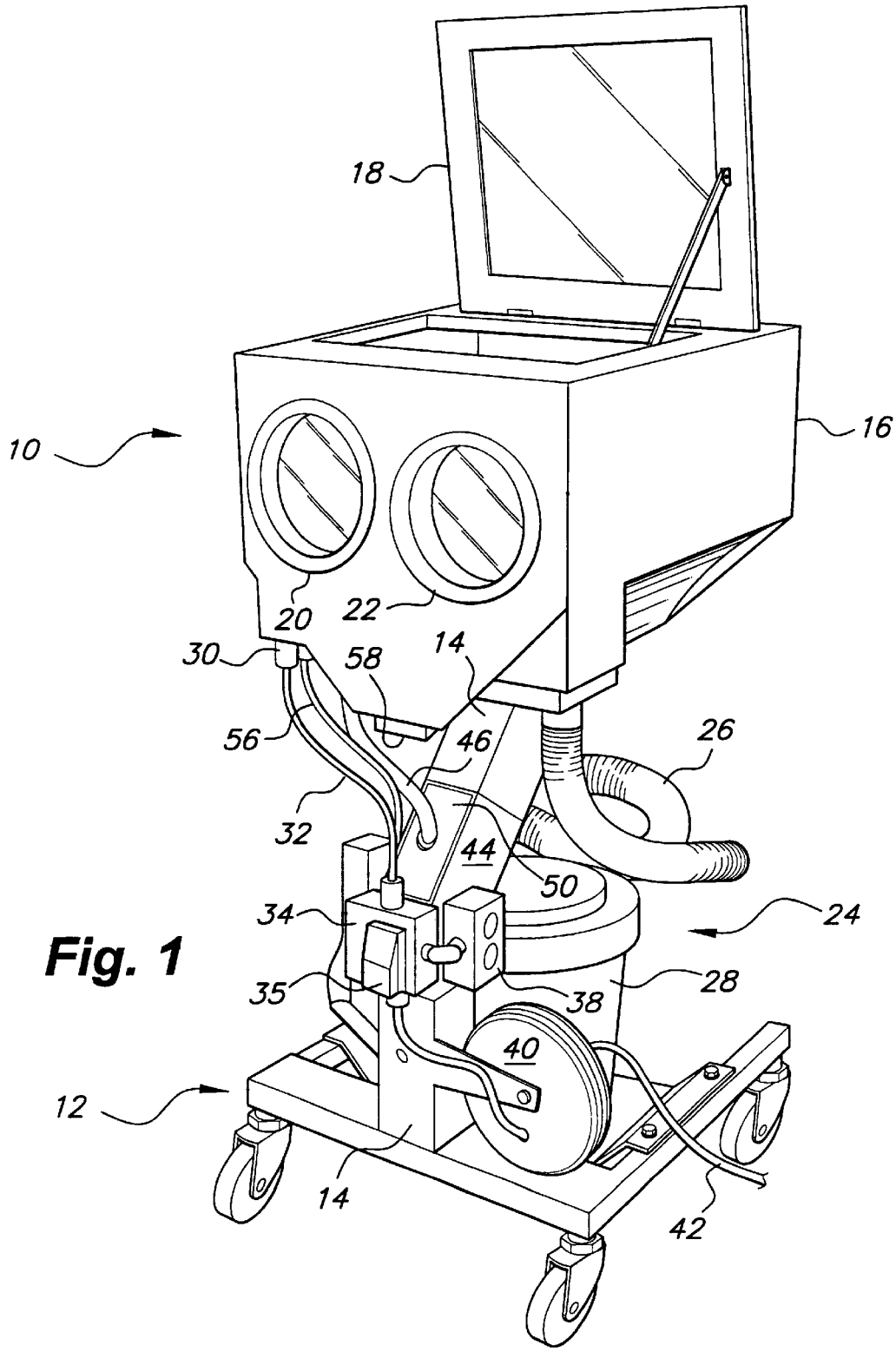
FIG. 1 is an elevational perspective view of a portable sand blasting cabinet according to the present invention.
Figure 4:
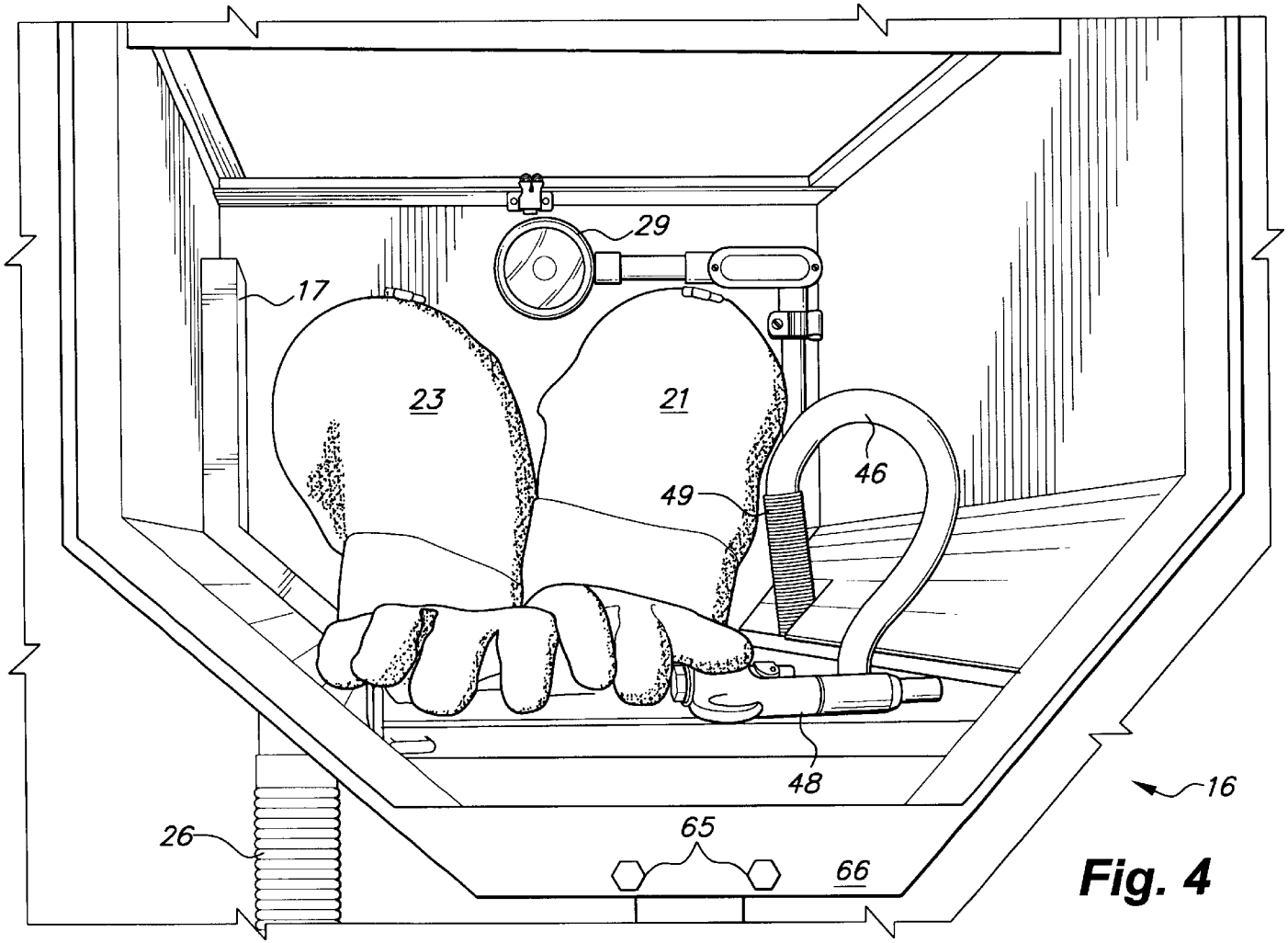
FIG. 4 is an elevational view of the interior of the cabinet, looking toward the glove ports.
Figure 8:
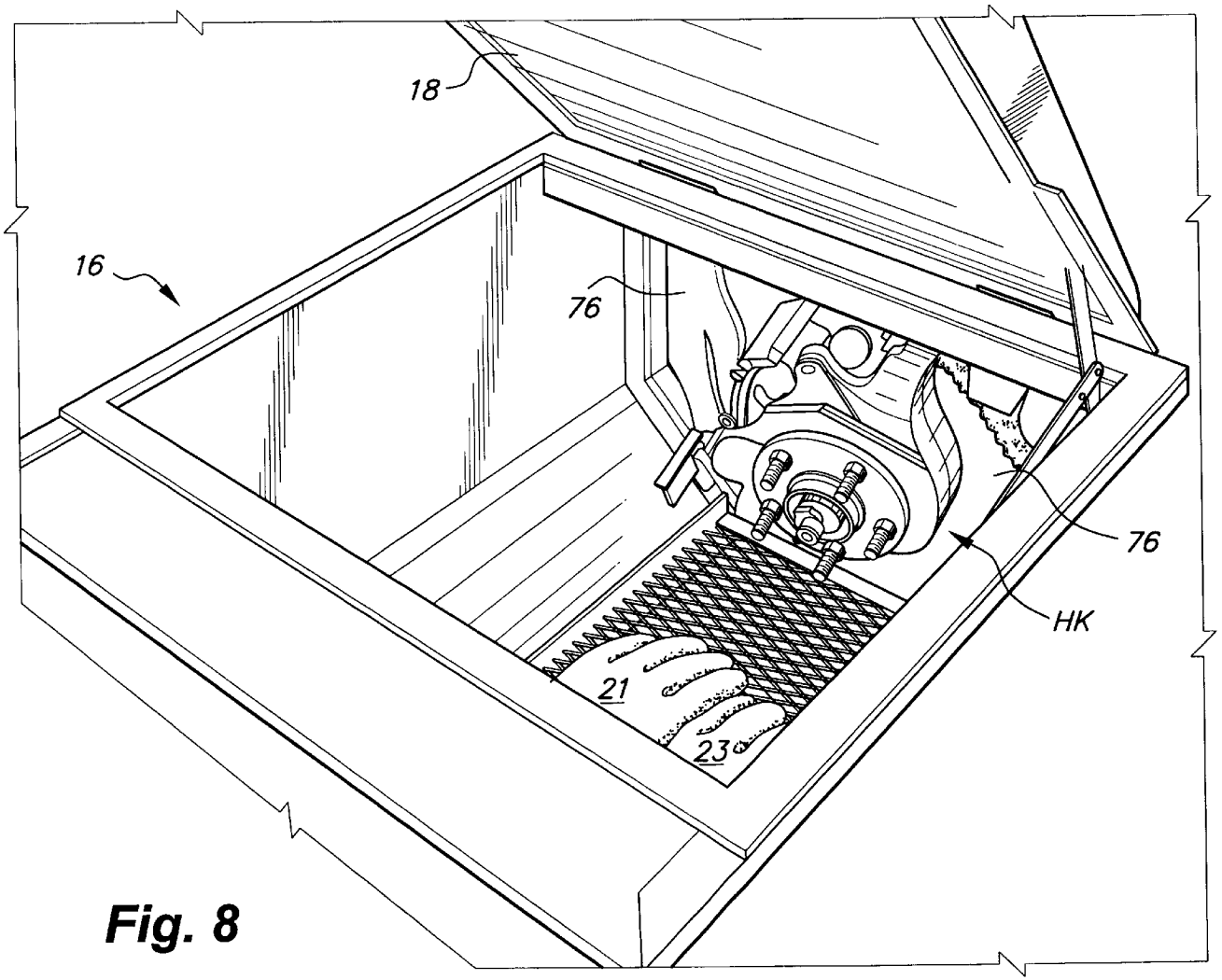
FIG. 8 is a perspective view of the inside of the cabinet, a softboot end cap having been placed about a workpiece (e.g., the hub and knuckle of a brake assembly) and the cabinet moved toward the workpiece, so it is inside the cabinet, ready for a sandblasting operation.

With particular reference to FIG. 1, the present invention 10 includes a caster wheeled, U-shaped base 12, support beam assembly 14 and a cabinet body 16. An upwardly pivotable lid 18 closes the top of the cabinet, and includes a clear panel so that work can be observed during a cleaning operation, as is conventional. A pair of otherwise conventional glove ports or sockets 20, 22 are provided on a front wall of the cabinet body 16. As can be seen in FIGS. 4 and 8, the glove ports include gloves 21 and 23.

Figure 2:
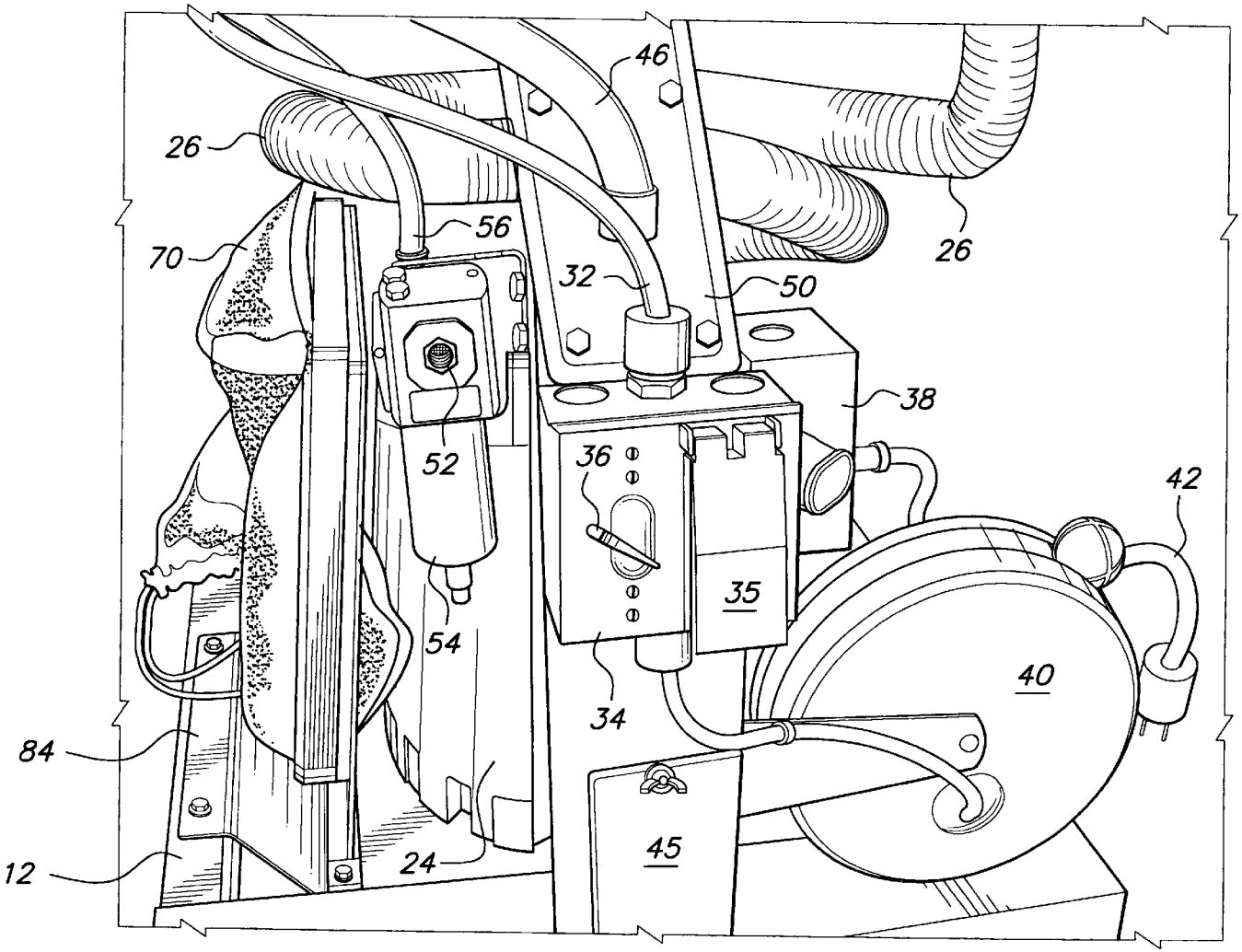
FIG. 2 is an enlarged scale perspective view of the major sandblasting components.

Turning now to FIGS. 1, 2 and 4, a vacuum in the form of a shop vacuum 24 has an inlet hose 26 connected to the bottom of cabinet 16. There is a chimney 17 (FIG. 4) within cabinet 16 above the hose 26 for intake of airborne dust particles. The vacuumed dust is retained in the shop vacuum canister 28 which is emptied periodically. The interior of the cabinet 16 is illuminated by a light 29 (FIG. 4) wired into the cabinet at 30. A power cord 32 connects the light 29 to a switch box 34. A light control switch is provided at 36 (see FIG. 2). The power cord from the shop vacuum 24 is plugged into one of the receptacles on a receptacle box 38. A main power cord reel 40 is mounted on the base 12 and has a male plug (not shown) on end 42 for connection to a source of electricity. It should be noted here that the switch box 34 is located at about the knee level of a user, and has a knee operated switch 35 for the shop vacuum located thereon. Thus, the shop vacuum may be turned on and off by the user's knee without need of withdrawing a hand from one of the glove ports to accomplish the task.

Figure 3:
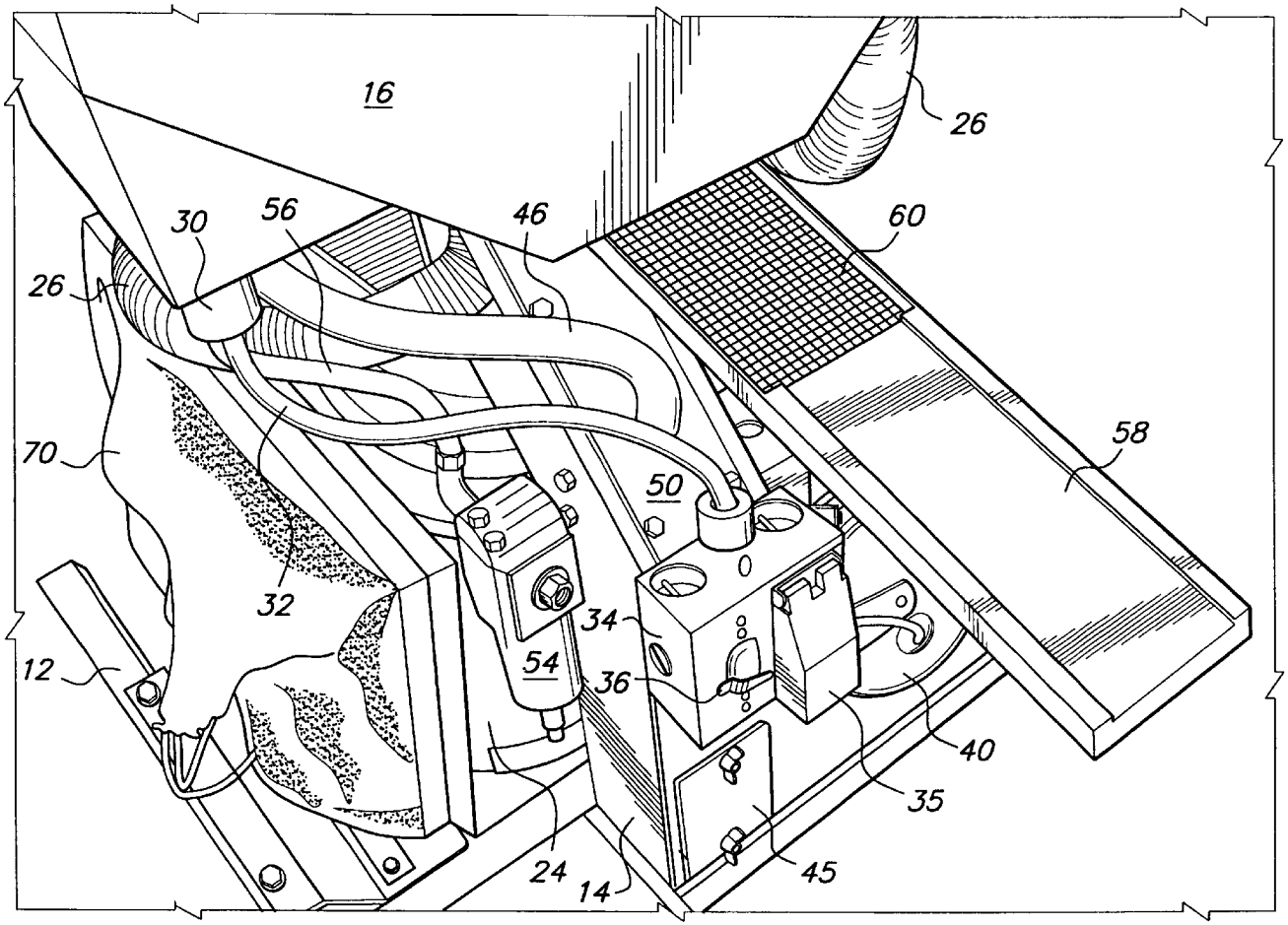
FIG. 3 is a perspective view of components including the pullout media filter tray.

A supply of media (sand, e.g.) is stored within a container 44 formed within the main support beam 14. A sand transfer or feed tube 46 leads from the supply container 44 to the sand blasting gun 48 (see FIG. 4) in the cabinet 16. An anti-kink spring 49 surrounds the tube 46 where it enters the cabinet 16. Ordinarily, media or sand is loaded into the container through the funnel formed and the bottom interior of cabinet 16. A top 50 of container 44 could be removed for cleaning purposes or periodic replenishment of the media. As seen at the bottom of FIG. 3, there is a media drain at 45, including a cap retained by a pair of wing nuts. A source of compressed air (not shown) is connected at 52 (see FIG. 2) to an air dryer 54 and thence to a compressed air hose 56 and the sand blasting gun 48 (see FIG. 4). The operation of the sand blasting gun is conventional and need not be discussed further.

With reference to FIG. 3, a pull out filter tray 58 includes a media filter screen 60 positioned over the lower base of the cabinet 16 where spent media drains back into container 44 for recycling use. The mesh diameter of filter screen 60 is selected such that particles of rust dislodged from a workpiece are retained and do not fall back into the media supply. Chunks of rust could jam the sandblasting gun 48 or its outlet port, rendering the gun at least temporarily inoperable. The tray is pulled out (see FIG. 3) and dumped occasionally; the media filter screen 60 may also need replacing from time to time.

The various replaceable end walls for an end of the cabinet 16 will now be discussed. The first is a solid end wall cap 62 used for conventional sandblasting operations, wherein a suitable workpiece is place inside the cabinet, the lid 18 is sealed, and sandblasting proceeds, with the operator using the gloves 21, 23 to manipulate the sandblasting gun 48 to clean the workpiece. The solid cap 62 is opaque; preferably it is fabricated from 11 gauge steel plate.

Figure 6:
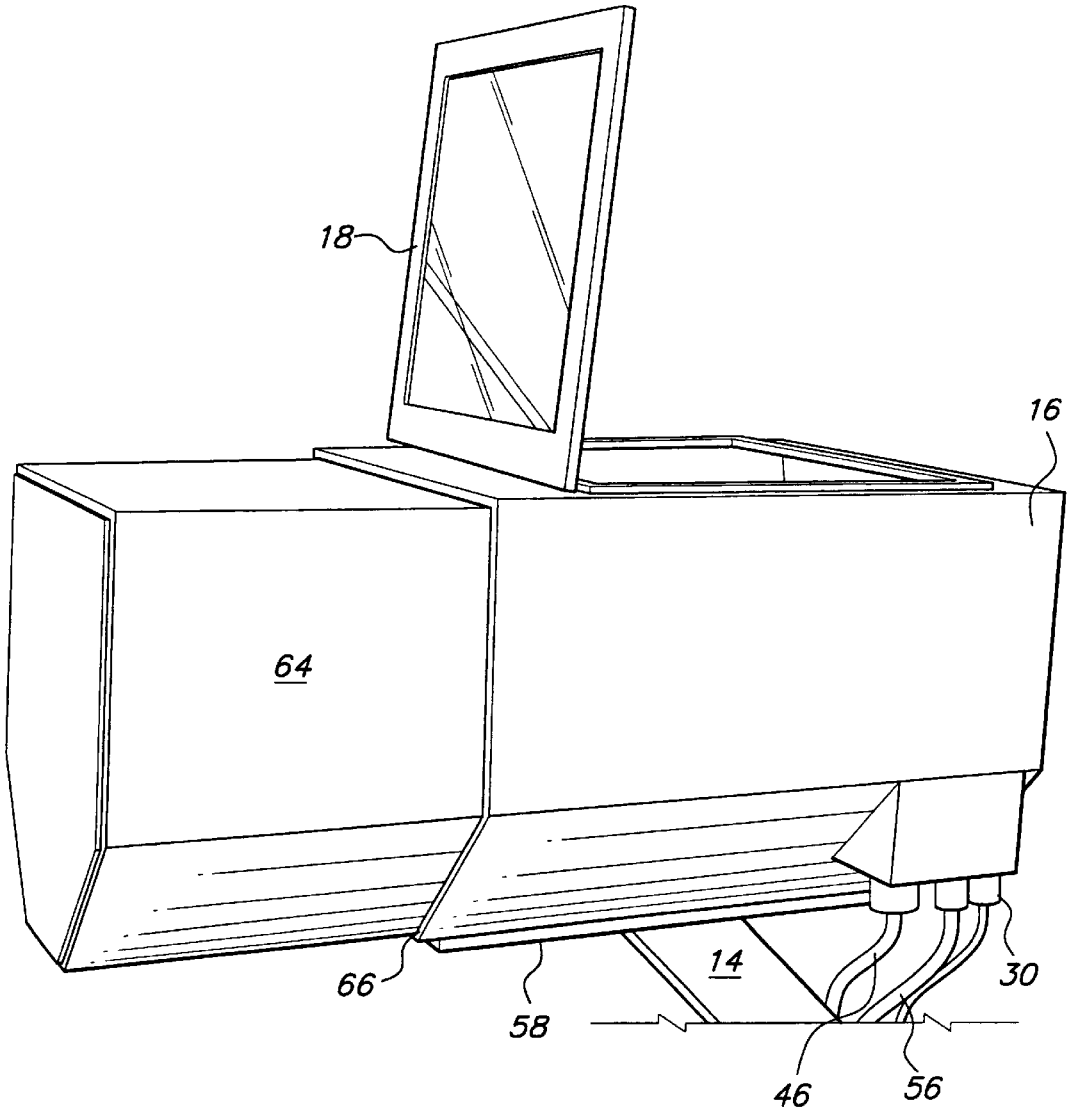
FIG. 6 is a view similar to FIG. 5, but showing the cabinet equipped with an extended solid end cap.

A solid, extended length box 64 is shown in FIG. 6, which replaces cap 62 when it is necessary to work on an extended length workpiece. Quick-disconnect mounts may be provided to ease the exchange for cap 62. These could include slide-in mounting studs 65 (see bottom, FIG. 4) at the bottom end 66 of cabinet 16 for the bottom of the end cap, with the upper end of the end cap held in place by an overcenter pivoting latch 68, which is seen in FIG. 7.

Figure 7:
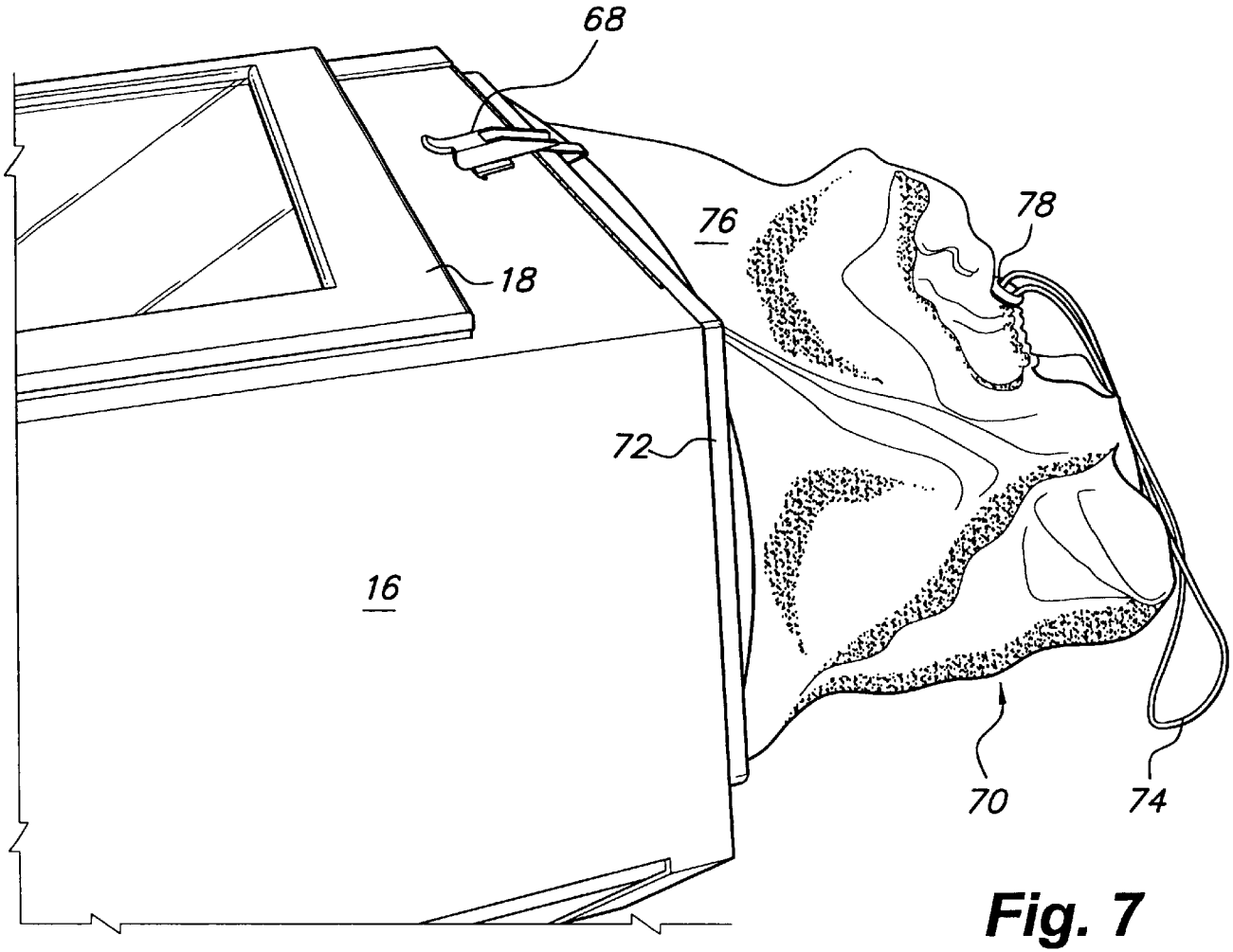
FIG. 7 is a detail perspective view showing a softboot end cap with a drawstring closure tied ready for placement about a workpiece.

A drawstring softboot end wall 70 is illustrated in FIG. 7, with the latch 68 to retain the wall 70 in sealing engagement with the end of cabinet 16. A suitable frame 72 mounts one end of the softboot wall 70, and the open opposite end includes a drawstring closure 74 which is drawn tightly about a workpiece that cannot be readily moved, or detached and placed in the cabinet 16, e.g., a brake assembly. The main body 76 will be made of a suitable material, which may be lined to further protect it from being damaged or torn due to an inadvertent sandblast from the gun 48. The drawstring 74 will include a locking keeper 78, preferably.

A typical operation for sandblasting a brake assembly, e.g., the hub and knuckle HK as seen in FIG. 8, can now be explained. A vehicle in a garage is lifted by the garage lift (not shown) so that the brake assembly to be cleaned is at the approximate level as the end of the cabinet 16 equipped with the softboot end cap 70. The main body 76 may be drawn out so that the drawstring end of the cap 70 may be placed over the brake assembly, and then the drawstring 74 is drawn tight about the brake assembly. Then the entire sandblasting unit is moved toward the workpiece, HK in this instance, so that the workpiece is actually within the end of the cabinet 16 as can be appreciated from FIG. 8. The unit is then sandblasted clean, the cabinet and sandblasting unit is moved away form the workpiece HK, the drawstring 74 is untied and removed from the workpiece HK, and finally the sandblasting unit is moved away from the vehicle.

Figure 9:
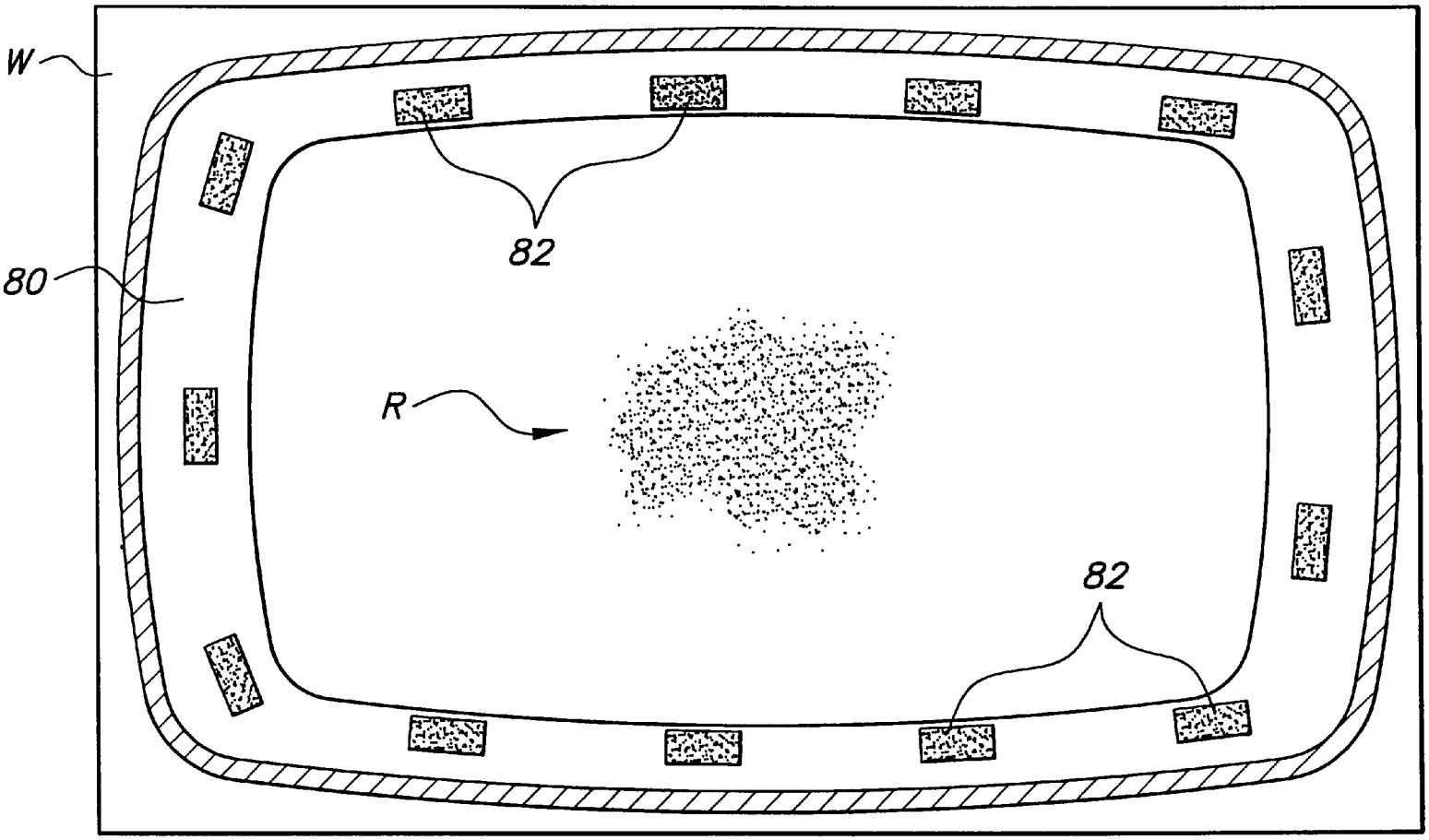
FIG. 9 is an inside, detail view of a magnetic softboot end cap in position on a relatively flat workpiece having a rusted area to be sandblasted.

The outer end 80 of a magnetic softboot end wall is shown in FIG. 9. This end wall or cap is in all respects the same as the drawstring end wall or cap 70, except that the drawstring end is replaced by a series of magnets 82 sewn into or otherwise retained in the hem of the outer end 80. Usually, the magnets 82 will be about two inches long and spaced apart about two inches from one another. A workpiece (for example, a vehicle door) W is shown with a rusted region R which is about to be sandblasted clean. The magnets 82 retain the boot neatly in place, in a sealed relationship with the piece W, thus to minimize the escape of media or dust.

Figure 5:
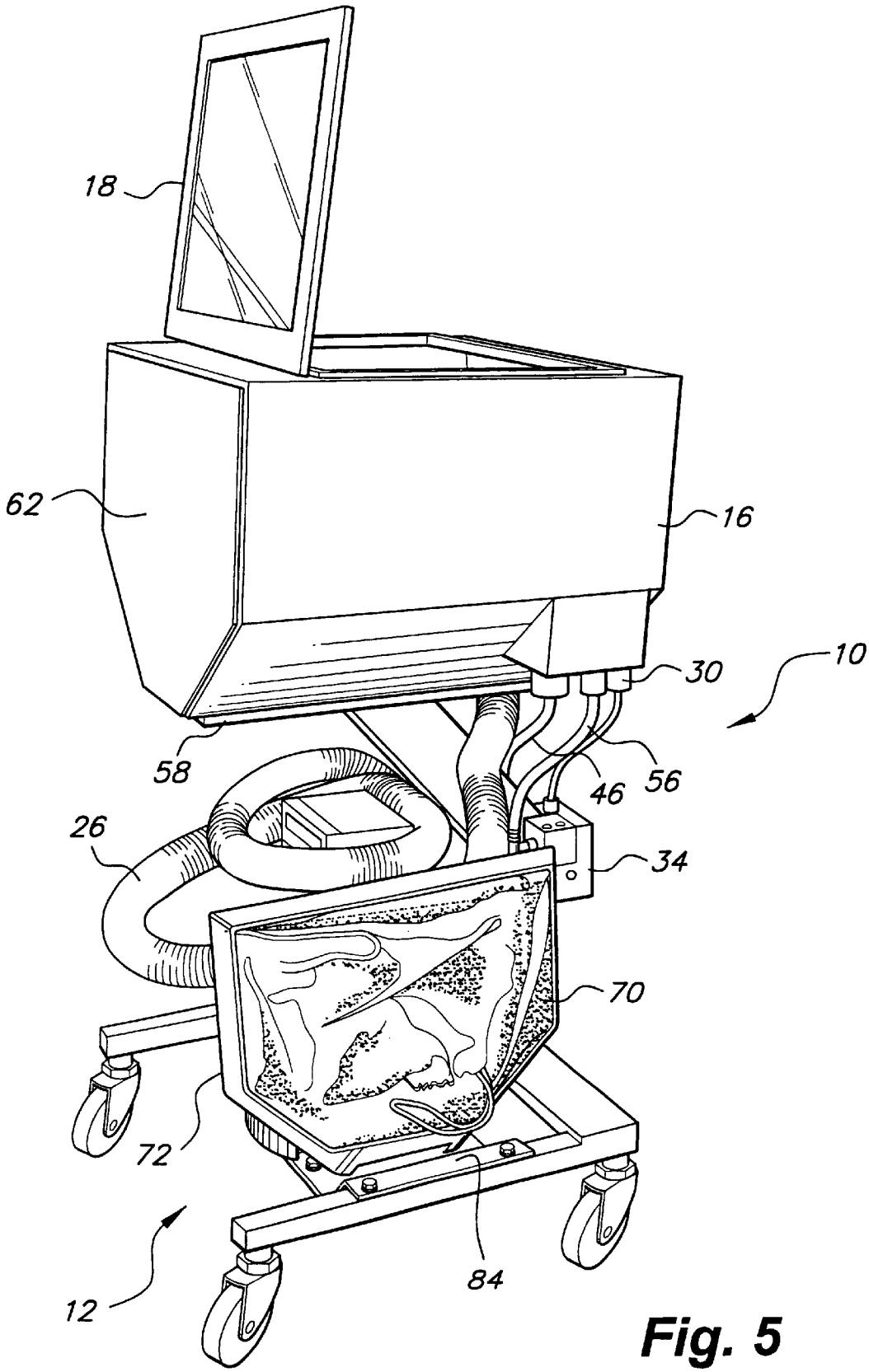
FIG. 5 is an elevational perspective view similar to FIG. 1, showing the rear of the cabinet and a solid end cap.

When not in use, one or more of the spare end walls or caps may be stored in a bracket storage keeper mounted on the caster wheeled base 12. One such keeper 84 is shown in FIG. 5.

It is to be understood that the present invention is not limited to the embodiments described above, but encompasses any and all embodiments within the scope of the following claims.

We claim:

1. A portable sand blasting cabinet comprising:

a base;

a sand blasting cabinet having generally vertical walls mounted on said base;

a media supply chamber beneath said cabinet, for holding a quantity of recyclable sandblasting media therein;

a sandblasting gun adapted for use in said cabinet;

means for connection of said gun to a source of compressed air;

glove ports defined in a vertical wall of said cabinet; and an interchangeable end wall on said cabinet.

2. The portable sand blasting cabinet of claim 1, further comprising a media filter screen, a movable tray mounting the screen and pulled out from beneath the cabinet to dump collected debris therefrom, the screen mesh being sized to retain rust clumps that could otherwise be returned to the sand supply and jam the gun.

3. The portable sand blasting cabinet of claim 1, wherein the end wall is an extended length box for extended length workpieces.

4. The portable sand blasting cabinet of claim 1, wherein the end wall is a softboot end cap with an open end, there further being a drawstring closure about said open end to close said open end about a workpiece.

5. The portable sand blasting cabinet of claim 1, wherein the end wall is a magnetic softboot end cap with an opening, there further being a series of magnets surrounding the opening so as to close the opening against a workpiece surface.

6. The portable sandblasting cabinet of claim 1, further comprising a vacuum for removing airborne dust particles from said cabinet, a light for illuminating the interior of said cabinet, a power cord for connection to a source of electricity, and a strategically located main power, rocker switch for said vacuum, which may be operated by a user's knee.

7. A kit of sandblasting cabinet interchangeable end walls comprising;

a solid end wall wherein the cabinet functions as a regular sand blasting cabinet; and an interchangeable end wall selected from the group consisting of a drawstring softboot end wall, a magnetic softboot end wall, and a solid, extended length box.

8. The kit of claim 7, wherein the end wall is an extended length box for extended length workpieces.

9. The kit of claim 7, wherein the end wall is a softboot end cap with an open end, there further being a drawstring closure about said open end to close said open end about a workpiece.

10. The kit of claim 7, wherein the end wall is a magnetic softboot end cap with an opening, there further being a series of magnets surrounding the opening so as to close the opening against a workpiece surface.

11. An interchangeable end wall structure for a sandblasting cabinet comprising:

a softboot end cap with two open ends, a first open end dimensioned and configured to close sealingly against a sandblasting cabinet chamber, and a second open end dimensioned and configured to be positioned about a workpiece to be sandblasted.

12. The interchangeable end wall structure for a sandblasting cabinet of claim 11, wherein said second open end includes a drawstring closure for sealing said second end about a workpiece.

13. The interchangeable end wall structure for a sandblasting cabinet of claim 11, wherein said second open end includes a plurality of magnets about said second open end, for sealingly engaging a metal workpiece.

* * * * *